US009650184B2

(12) United States Patent
Fily et al.

(10) Patent No.: US 9,650,184 B2
(45) Date of Patent: May 16, 2017

(54) PACKAGE CONTAINING TAMPER EVIDENCE FEATURES

(75) Inventors: Sébastien Lucien Fily, Gaillard (FR); William Leonard Morley, Evian (FR); Vincent Sebille, Etampes (FR); Stéphane Rault, Paris (FR)

(73) Assignee: Clariant Production (France) S.A.S., Choisy le Roi (FR)

( * ) Notice: Subject to any disclaimer, the term of this patent is extended or adjusted under 35 U.S.C. 154(b) by 484 days.

(21) Appl. No.: 12/151,698

(22) Filed: May 8, 2008

(65) Prior Publication Data

US 2009/0071927 A1 Mar. 19, 2009

(51) Int. Cl.
*B65D 43/00* (2006.01)
*B65D 47/08* (2006.01)

(52) U.S. Cl.
CPC .. *B65D 47/0838* (2013.01); *B65D 2101/0061* (2013.01); *B65D 2101/0092* (2013.01)

(58) Field of Classification Search
CPC .... B65D 2101/0023; B65D 2101/0038; B65D 2101/003; B65D 2101/0053; B65D 2543/00092; B65D 2543/00296; B65D 2543/00685; B65D 2543/00537; B65D 41/485; B65D 55/024
USPC ..... 215/250, 253, 254, 256; 220/265, 220/268–270
See application file for complete search history.

(56) References Cited

U.S. PATENT DOCUMENTS 906,875 A * 12/1908 Hammer ..... 215/254
1,875,431 A * 9/1932 Fabrice ..... 215/251
3,255,928 A * 6/1966 Foster ..... 222/153.07
3,642,161 A * 2/1972 Stroud ..... 215/213
3,707,240 A * 12/1972 Wilson ..... 215/256
3,850,326 A * 11/1974 Ryles ..... 215/224
3,860,148 A * 1/1975 Sherin ..... 222/153.06
3,957,169 A * 5/1976 Coursaut ..... 215/253
4,024,976 A * 5/1977 Acton ..... 215/50
D248,373 S * 7/1978 Allen ..... D9/503
D256,672 S * 9/1980 Beck ..... D9/454
4,320,843 A * 3/1982 Dubach ..... 215/256
4,354,610 A * 10/1982 Kessler et al. ..... 215/253
4,385,708 A * 5/1983 Curry ..... 215/256
(Continued)

FOREIGN PATENT DOCUMENTS

CN 2737710 Y 11/2005 ..... B65D 55/02
FR 2707958 7/1993 ..... B65D 47/08
(Continued)

*Primary Examiner* — Anthony Stashick
*Assistant Examiner* — James Way
(74) *Attorney, Agent, or Firm* — Scott R. Cox

(57) ABSTRACT

A package containing tamper evident features includes a closure for closing the package and an access point that provides access to contents of the package. The closure includes a ring surrounding the closure which is connected to the package, a lid, substantially covering the access point when the lid is closed on the package, a removable tab secured between a portion of the lid and the ring and a plurality of tear off webs between the ring and the lid. The tear off webs are releasably connected between the ring and the lid. Opening of the package by opening the lid requires both removal of the tab from the tube and breaking of the first tear off webs. Removal of the tab forms a window at least partially provided in the lid.

20 Claims, 3 Drawing Sheets

(56) References Cited

U.S. PATENT DOCUMENTS

| | | | | | |
|---|---|---|---|---|---|
| 4,394,918 | A | * | 7/1983 | Grussen | 215/243 |
| 4,444,326 | A | * | 4/1984 | Musel | 215/209 |
| 4,457,437 | A | * | 7/1984 | Heath, Jr. | 215/224 |
| 4,487,324 | A | * | 12/1984 | Ostrowsky | 215/253 |
| 4,522,308 | A | * | 6/1985 | Sullivan | 215/253 |
| 4,527,702 | A | * | 7/1985 | Heath, Jr. | 215/225 |
| 4,531,650 | A | * | 7/1985 | Friendship | 215/256 |
| 4,533,058 | A | * | 8/1985 | Uhlig | 215/216 |
| 4,696,408 | A | * | 9/1987 | Dubach | 215/237 |
| 4,706,828 | A | * | 11/1987 | Zinnbauer | 215/246 |
| 4,752,013 | A | * | 6/1988 | Miller et al. | 215/216 |
| 4,752,014 | A | * | 6/1988 | House et al. | 215/216 |
| 4,771,923 | A | * | 9/1988 | Zinnbauer | 222/153.06 |
| 4,782,964 | A | * | 11/1988 | Poore et al. | 215/216 |
| 4,787,525 | A | * | 11/1988 | Joyce | 215/201 |
| 4,798,301 | A | * | 1/1989 | Bullock et al. | 215/256 |
| 4,828,128 | A | * | 5/1989 | Tackles | 215/256 |
| D305,735 | S | * | 1/1990 | Zinnbauer | D9/438 |
| 4,899,897 | A | * | 2/1990 | Buttiker et al. | 215/228 |
| 4,919,286 | A | * | 4/1990 | Agbay, Sr. | 215/235 |
| 4,934,556 | A | * | 6/1990 | Kleissendorf | 220/269 |
| 4,967,920 | A | * | 11/1990 | Dahl | 215/252 |
| 4,984,701 | A | * | 1/1991 | Margaria | 215/256 |
| 4,986,430 | A | * | 1/1991 | Dutt | 215/253 |
| 4,998,988 | A | * | 3/1991 | Zinnbauer | 215/230 |
| 5,040,691 | A | * | 8/1991 | Hayes et al. | 215/216 |
| 5,042,680 | A | * | 8/1991 | Argudo et al. | 220/276 |
| 5,129,531 | A | * | 7/1992 | Beck et al. | 215/256 |
| 5,139,163 | A | * | 8/1992 | Diaz | 220/258.2 |
| 5,141,138 | A | * | 8/1992 | Odet et al. | 222/153.07 |
| 5,201,440 | A | * | 4/1993 | Gross | 222/153.07 |
| 5,207,783 | A | * | 5/1993 | Burton | 215/256 |
| 5,219,087 | A | * | 6/1993 | Christensson | 220/270 |
| 5,307,948 | A | * | 5/1994 | Blackburn et al. | 220/269 |
| 5,373,954 | A | * | 12/1994 | Julian | 215/256 |
| D360,134 | S | * | 7/1995 | Snyder | D9/520 |
| 5,476,181 | A | * | 12/1995 | Seidler | 215/223 |
| D370,845 | S | * | 6/1996 | Sherman et al. | D9/438 |
| 5,538,154 | A | * | 7/1996 | Von Holdt | 220/277 |
| 5,605,240 | A | * | 2/1997 | Guglielmini | 215/256 |
| 5,875,907 | A | * | 3/1999 | Lay | 215/253 |
| 5,875,913 | A | * | 3/1999 | Letica | 220/269 |
| 5,875,942 | A | * | 3/1999 | Ohmi et al. | 222/556 |
| D411,744 | S | * | 6/1999 | Brach et al. | D9/438 |
| 5,938,054 | A | * | 8/1999 | Loader | 215/206 |
| 5,960,979 | A | * | 10/1999 | Van Den Brink et al. | 220/266 |
| 5,979,681 | A | * | 11/1999 | PatrickJean-Luc Andre et al. | 215/216 |
| 5,996,833 | A | * | 12/1999 | Lencioni et al. | 220/257.2 |
| D436,867 | S | * | 1/2001 | Spreitzer et al. | D9/772 |
| 6,257,435 | B1 | * | 7/2001 | Chedister et al. | 220/276 |
| 6,283,318 | B1 | * | 9/2001 | Lee | 215/254 |
| 6,341,707 | B1 | * | 1/2002 | Witt et al. | 215/256 |
| 6,405,885 | B1 | * | 6/2002 | Elliott | 215/237 |
| 6,409,034 | B2 | * | 6/2002 | Schorner | 215/237 |
| 6,520,370 | B2 | * | 2/2003 | Nyman et al. | 220/832 |
| 6,631,820 | B2 | * | 10/2003 | Harrold et al. | 215/237 |
| 6,644,487 | B2 | * | 11/2003 | Peterson et al. | 215/235 |
| 6,848,603 | B2 | * | 2/2005 | Gaiser et al. | 222/153.1 |
| 6,926,165 | B2 | * | 8/2005 | Conti | 220/288 |
| 6,976,607 | B2 | * | 12/2005 | Benoit-Gonin et al. | 222/153.06 |
| 7,044,317 | B2 | * | 5/2006 | Smith et al. | 215/235 |
| D527,633 | S | * | 9/2006 | Stull et al. | D9/454 |
| 7,118,003 | B2 | * | 10/2006 | Sellari et al. | 220/266 |
| 7,156,247 | B2 | * | 1/2007 | Laburu | 215/235 |
| D563,783 | S | * | 3/2008 | Fily et al. | D9/439 |
| 7,374,053 | B2 | * | 5/2008 | Herald et al. | 215/237 |
| 7,469,795 | B2 | * | 12/2008 | Druitt et al. | 215/235 |
| 7,604,139 | B1 | * | 10/2009 | Long, Jr. | 215/256 |
| 7,731,048 | B2 | * | 6/2010 | Teixeira Alvares et al. | 220/270 |
| 7,735,665 | B2 | * | 6/2010 | Robinson | 215/237 |
| 8,083,089 | B2 | * | 12/2011 | Vovan | 220/359.2 |
| 2001/0050264 | A1 | * | 12/2001 | Schorner | 215/237 |
| 2002/0079282 | A1 | * | 6/2002 | Harrold et al. | 215/237 |
| 2002/0088813 | A1 | * | 7/2002 | Nyman et al. | 220/832 |
| 2002/0104852 | A1 | * | 8/2002 | Staniszewski et al. | 222/153.07 |
| 2003/0034323 | A1 | * | 2/2003 | Smith et al. | 215/235 |
| 2004/0069806 | A1 | * | 4/2004 | Benoit-Gonin et al. | 222/153.06 |
| 2004/0188374 | A1 | * | 9/2004 | Ochoa Laburu | 215/235 |
| 2004/0256347 | A1 | * | 12/2004 | Druitt et al. | 215/235 |
| 2005/0017007 | A1 | * | 1/2005 | Sellari et al. | 220/270 |
| 2005/0023285 | A1 | * | 2/2005 | Keung | 220/835 |
| 2005/0092751 | A1 | * | 5/2005 | Alvares et al. | 220/270 |
| 2005/0230342 | A1 | * | 10/2005 | Folchini et al. | 215/254 |
| 2005/0252916 | A1 | * | 11/2005 | Varadarajan | 220/257.1 |
| 2005/0279727 | A1 | * | 12/2005 | Graswald et al. | 215/237 |
| 2006/0011573 | A1 | * | 1/2006 | Herald et al. | 215/237 |
| 2006/0043052 | A1 | * | 3/2006 | Lin | 215/253 |
| 2006/0186077 | A1 | * | 8/2006 | Robinson | 215/237 |
| 2006/0186078 | A1 | * | 8/2006 | Ziegenhorn | 215/237 |
| 2006/0186079 | A1 | * | 8/2006 | Ziegenhorn | 215/237 |
| 2006/0249474 | A1 | * | 11/2006 | Sawyer et al. | 215/256 |

FOREIGN PATENT DOCUMENTS

| | | | | |
|---|---|---|---|---|
| FR | 2733964 | A1 * | 11/1996 | |
| JP | 2000033965 | A * | 2/2000 | |
| JP | 2004 175436 | | 6/2004 | B65D 49/12 |

* cited by examiner

PACKAGE CONTAINING TAMPER EVIDENCE FEATURES

1. FIELD OF THE INVENTION

This invention relates to tamper evident closure for a tube, container or package.

2. BACKGROUND OF THE INVENTION

Tamper evident closures of various types are well known. One type of tamper evident closure comprises a tamper evident ring. Tamper evident closures with tamper evident rings are used for bottles and other containers with closures that generally have a diameter of about 5 to 6 centimeters or less, such as bottles or tubes for tablets, especially effervescent tablets. European Patent No. P 0 202 506, for example, discloses a container with a closure comprising a tamper evident ring.

Tamper evident closures known in the art may also comprise a tamper evident tab that may be on one side of the closure and be connected to the lid and the body of a tube, container or package by a tear-off and tamper evident web. The tab must be removed before opening the closure. Tamper evident tabs are often used for plastic, large diameter (more than 5 to 6 cm) cup-like packages with a lid.

Tamper evident tabs may be used with tubes as in French Patent No. 2,707,958 and Japanese Application No. 2004/175,436. Tamper evident tabs are readily apparent to the consumer, and a consumer may easily perceive whether the tamper evident closure has been broken or manipulated. This determination is harder with the tamper evident ring. In addition, it is easier to peel off a tamper evident tab than to break apart a tamper evident ring.

Although tabs have certain advantages, they also have certain drawbacks. If a tamper evident tab has been removed it is not always clear that the tube, container or package has actually been opened. Consumers might therefore unnecessarily reject or discard a tube, container or package, simply because the tab had been removed, even though the tube, container or package had not, in fact, been opened.

Tamper evident rings do not snap off the packaging as readily as tabs. But, it is easier for consumers to miss the fact that the ring has become detached from the packaging. Thus, a tamper evident ring might not protect the consumer if the tube, container or package had been opened. Another disadvantage of tamper evident rings is that the tamper evident ring can fall down the tube, container or package when the tear-off and tamper evident webs connecting the ring to rest of the packaging are broken.

Neither tabs nor rings, acting alone, have proven to be fully adequate to warn consumers of tampering without the false positive of missing or damaged tabs or the potential false negative of an overlooked detached ring.

SUMMARY OF THE INVENTION

The principal object of the invention therefore is to provide a closure which alerts the consumer that the tube, container or package had been manipulated while allowing the consumer to avoid discarding tubes, containers or packages unnecessarily.

Another object of the invention is to provide a system for showing evidence of tampering in a package with a primary and secondary warning to reduce to possibility of false positive and false negative indications.

Additional objects and advantages of the invention will be set forth in part in the description that follows, and in part will be obvious from this description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the invention provides a closure for a tube, container or package having a ring connected to the tube, container or package; a lid connected to the ring both by means of a tab that is connected to the lid and the ring through tear off and tamper evident webs and tear-off/tamper evident webs between the ring and the lid.

An advantage of the invention is that the interconnected systems provide complementary systems for showing package tampering. The false positive of a tab that can become dislodged accidentally is offset by the ring, and the false negative of the ring is offset by the more visible tab.

Another advantage of the invention is that the package design directs the attention of the person opening the package to the tamper evident system at the time the package is opened for use. Thus, the attention of the consumer is directed to the tamper evident status of the packaging at the time the product contained in the package is to be used rather than at some other time when the consumer might not focus attention on the tamper evident status of the product.

DETAILED DESCRIPTION OF THE PREFERRED EMBODIMENTS OF THE INVENTION

Reference will now be made in detail to the presently preferred embodiments of the invention.

The invention comprises a package, such as a tube (for holding a roll of tablets or the like), a container, optionally having a narrowed neck, or any enclosure for a product designed to be opened at an access point. The invention further comprises a closure at the access point having tamper evident features. "Tamper evident" as used herein means that a person may reasonably determine whether the closure has been opened at least once by ordinary sensory perception, usually visual perception. The tamper evident features are also "tear off," which means that, in opening the closure for the first time the features break or are deformed due to the application of force to the closure that is applied during the process of opening. The break or deformation of the features should be sufficient so that it will be revealed upon ordinary visual inspection.

The invention further comprises a lid for the closure that may be opened to gain access to the interior of the package through the closure and a ring that defines the outer boundary of the access point. The ring and the lid are not limited to any particular shape or design, but they are preferably complementary shapes, so that the lid engages the ring upon closing to reseal the closure.

The tamper evident features of the invention are intended to operate in the vicinity of the access point, without limiting the size or shape of the package or the product within the package. The tamper evident features include a tab that must be removed from the closure or deformed away from the closure during the first opening process and a plurality of small webs disposed around the ring that temporarily bind the lid and optionally the tab to the ring and optionally the tab to the lid before first opening. Upon opening these webs may be broken or deformed in an irreversible manner so that one inspecting the package may determine whether the closure has already been opened.

Figure 1:
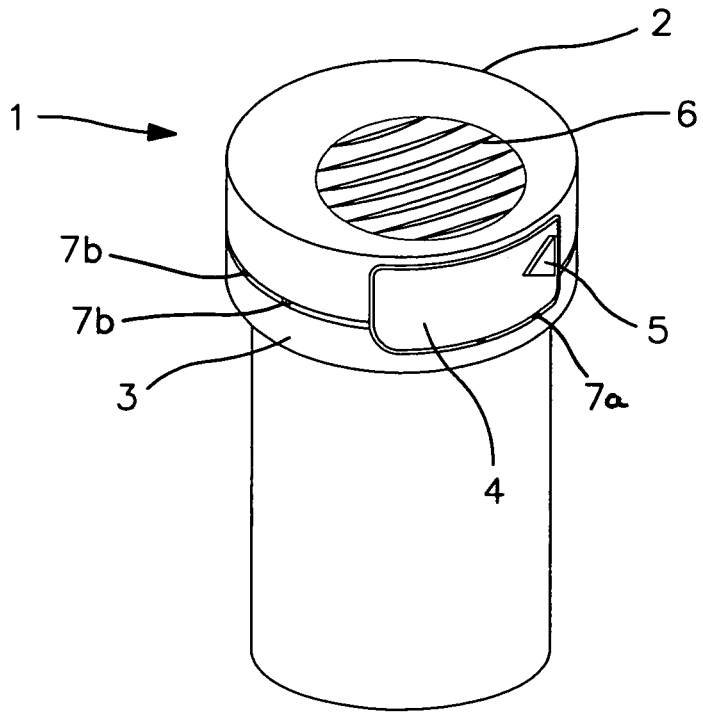
FIG. 1 shows a tamper evident system of the invention with a tab and a ring before the package is first opened.

For ease of reference, but without limiting the scope or spirit of the invention, FIG. 1 shows a package in accordance with the invention comprising a generally cylindrical tube designed to hold a plurality of tablets in a "roll" configuration. Generally cylindrical tubes made of rigid plastic, polymeric materials, or aluminum are preferred for the invention. If the closure is made of plastic or polymeric material, then the tubes may be easily fabricated by injection molding.

As shown in FIG. 1, the invention comprises a closure (shown before the first opening). The closure 1 comprises a lid 2, a ring 3 and a tab 4. Ring 3 is connected to the tube and lid 2. Lid 2 and ring 3 are attached to each other by a hinge 8, tab 4 and a plurality of tear off and tamper evident webs joining ring 3 and lid 2. Tab 4 is also attached to ring 3 and lid 2 by a plurality of tear off and tamper evident webs. An arrow 5 is placed on tab 4 as a guide for the consumer and gripping parts 6 are provided to assist in opening and closing the package.

Figure 2:
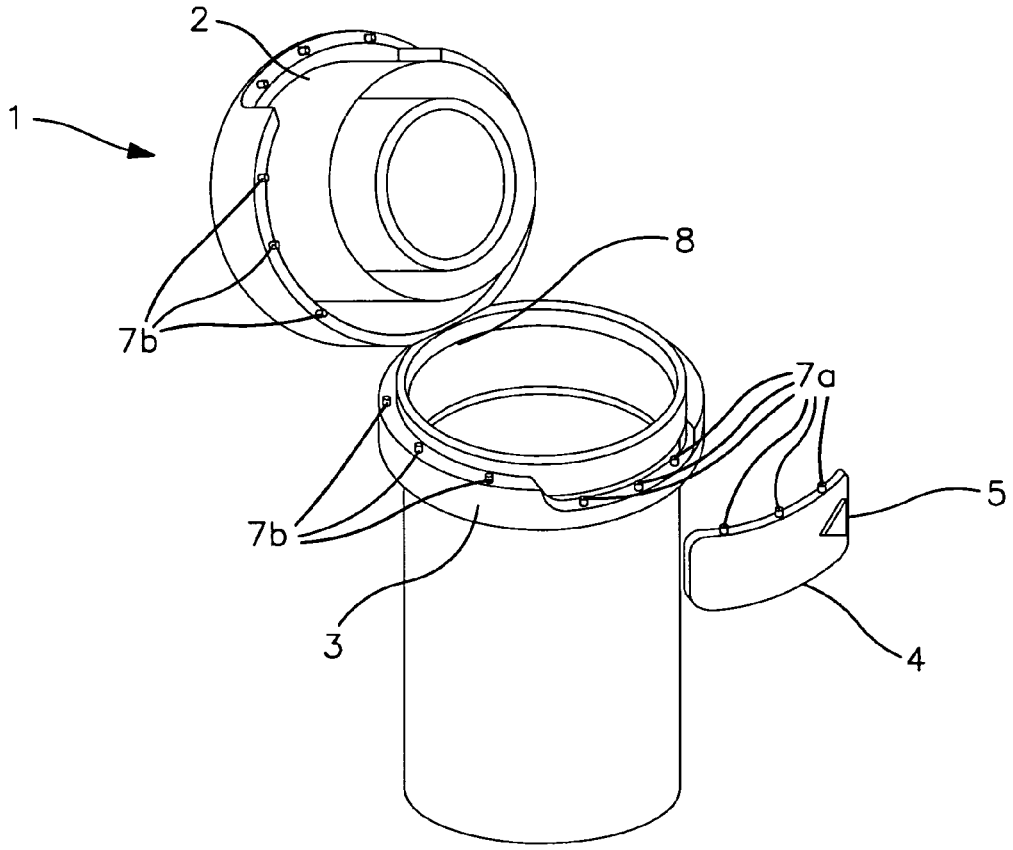
FIG. 2 shows the tamper evident system of the invention after the package is opened.

FIG. 2 shows the closure of FIG. 1 after it has been opened. Closure 1 has been opened by tearing off tab 4 and raising lid 2, thereby breaking the tear off and tamper evident webs 7*a* and 7*b*. Ring 3 and lid 2 are still connected to each other by hinge 8, but tear off webs 7*b* between ring 3 and lid 2 have been broken. One part of the periphery of tab 4 had been connected through tear off and tamper evident webs (not shown) with the ring 3. The other part of the periphery of tab 4 had been connected through tear off and tamper evident webs 7*a* to lid 2. Tab 4, however, has been detached from closure 1. The tear off and tamper evident webs 7*a* between tab 4 and ring 3, and the tear off and tamper evident webs between tab 4 and lid 2 have been broken.

Figure 3:
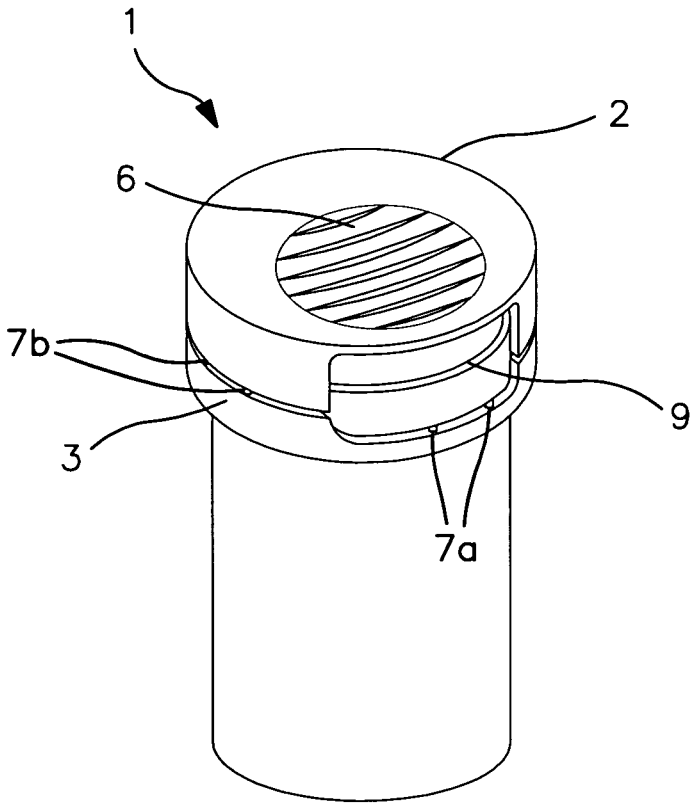
FIG. 3 shows the tamper evident system of the invention before the package is first opened, but with the tab removed.

FIG. 3 shows closure 1 in closed state after first opening. Tab 4 has been removed, and an open area, window 9, is now accessible where tab 4 had been. Closure 1 can be opened by the user with only one hand by putting the thumb into the window 9 and pushing up on the exposed edge of lid 2. Lid 2 can be closed again by means of the gripping parts 6 by pushing on the top of lid 2 with a finger or with the thumb. The tamper evident features of the closure include both the missing tab 4 and the burrs left from broken webs 7*a* and 7*b*. Both the missing tab and the burrs may be detected by visual or tactile inspection of the package.

Before the package is opened for the first time tamper evident ring 3 and tab 4 are connected to lid 2 by means of tear off and tamper evident webs 7*a* and 7*b* and by hinge 8. To open the tube for the first time, it is first necessary for the consumer to remove tab 4, which breaks the tear off and tamper evident webs between tab 4 and both ring 3 and lid 2. An open area, window 9 then becomes accessible where tab 4 has been removed. The consumer can put his or her thumb into window 9 to push up lid 2, which opens by pivoting on hinge 8. At this point, tear off and tamper evident webs 7*b* between ring 3 and lid 2 are also broken. The hinge 8 is left as a connection between lid 2 and ring 3 and helps prevent the ring from dropping down the tube. In an alternative embodiment the ring can be designed such that an inside part of the ring extends over the lip of the access point, such as the lip of the tube shown in FIG. 1, so that ring 3 would be prevented from falling down even in the absence of hinge 8.

Preferably the tear off and tamper evident webs are located around lid 2, ring 3 and tab 4 at predetermined distances from each other, more preferably at equidistant points from one another. In an alternative embodiment, to adjust the force required for opening lid 2 for the first time, the tear off and tamper evident webs joining the ring and lid 2 are arranged such that more of the webs are nearer to tab 4 or farther away from tab 4. In another alternative embodiment, more or fewer webs may be used, resulting in less or more empty space between each web.

In one embodiment of the invention, tab 4 may be located opposite hinge 8 on the periphery of the closure. Preferably, the tab should not extend beyond the external diameter of the ring, to assure better efficiency on packing lines and to reduce accidental removal of the tab during processing and distribution of the package. The tab may have any size and shape, but, for typical packaging of tablets or other similar items, the tab preferably has a width from about 8 mm to about 40 mm, more preferably from about 15 mm to about 25 mm, and most preferably about 20 mm. The tab may also preferably have a height of about 2 mm to about 20 mm, more preferably from about 7 mm to about 13 mm and most preferably about 10 mm. These dimensions are preferred for an application in which a human finger or thumb is to be used to open the lid. A pictogram, design or a wording, such as arrow 5, may be applied to the tab, preferably to indicate to the user how to remove the tab so that the lid may be opened.

The closure can be any shape, but circular or ellipsoid shapes are preferred for tablets and the like. Preferably the closure has a height from about 10 mm to about 40 mm, more preferably from about 15 mm to about 30 mm and most preferably about 22.5 mm. Preferably the closure has a total diameter of from about 10 mm to about 50 mm, more preferably from about 20 mm to about 40 mm, and most preferably about 34.5 mm. The lid may optionally contain a desiccant in a specific cavity, or it can contain an attached canister having a desiccant or other active material.

While the closure may use any design to open and close the lid, the closure is preferably comprises a snap-on type lid. In one embodiment of the invention gripping grooves 6 or other gripping aids may be placed on the lid or other points on the package to assist in opening or closing the package.

The invention also comprises a method for opening a closure for the first time, comprising the steps of detaching tab 4 from ring 3 and lid 2 by breaking the webs joining the tab 4 to the ring 3 and the lid 2 such that window 9 and the underside of a portion of lid 2 becomes accessible and then applying a force onto the underside of lid 2, i.e., by putting a thumb into window 9, and thereby breaking the tear off webs 7*b* joining the lid and the ring to open the closure. In the embodiment shown in FIGS. 1-3, the lid remains attached to the package through hinge 8. In an alternative embodiment, hinge 8 is not present, and lid 2 is separated from closure 1 upon opening.

In a preferred embodiment of the invention, the closure allows for the lid to be snapped back into place to recluse the package. In this embodiment, the next time the package is opened, the consumer may use his or her thumb to open the lid in the same manner as in the first opening, without the step of removing the tab.

The purpose of the above description is to illustrate some embodiments of the present invention without implying a limitation. It will apparent to those skilled in the art that various modifications and variations may be made in the apparatus or procedure of the invention without departing from the scope or spirit of the invention.

What is claimed is:

1. A package containing tamper evident features, comprising:

a. a closure for closing the package; and b. an access point that provides access to contents of said package;

wherein the closure comprises:

i. a ring, surrounding said closure and connected to said package;

ii. a lid, substantially covering said access point when said lid is closed;

iii. a single unitary one-piece removable tab secured between a portion of said lid and said ring; and iv. one or more first tear off webs disposed between said ring and said lid releasably and directly connecting said ring and said lid, wherein opening of said package by opening said lid requires both removal of said tab from said package and breaking of said first tear off webs, and wherein the removable tab covers a window being at least partially provided in the lid, whereby upon removal of the tab, a lid pushing portion for pushing upward the lid is formed, wherein said removable tab is directly connected to said ring and to said lid by a plurality of second tear off and tamper evident webs.

2. The package of claim 1, wherein said lid is additionally connected to said ring by a hinge.

3. The package of claim 1, wherein said first tear off webs are located at predetermined distances.

4. The package of claim 1, wherein said first tear off webs are located at equidistant points.

5. The package of claim 1, wherein said closure is circular or ellipsoid.

6. The package of claim 1, wherein a hinge is located opposite to said removable tab on said ring of said lid.

7. The package of claim 1, where said closure has a height from about 10 mm to about 40 mm.

8. The package of claim 7, wherein said closure has a diameter from about 10 mm to about 50 mm.

9. The package of claim 8, wherein said removable tab has a width from about 8 mm to about 40 mm.

10. The package of claim 9, wherein said removable tab has a height from about 2 mm to about 20 mm.

11. A package containing tamper evident features, comprising:

a. a container;

b. a closure for closing the container; and c. an access point that provides access to contents of said container;

wherein the closure comprises:

i. a ring, surrounding said closure and connected to said package;

ii. a lid, substantially covering said access point when said lid is closed;

iii. a single removable tab secured directly between a portion of said lid and said ring; and iv. one or more first tear off webs disposed between said ring and said lid directly and releasably connecting said ring and said lid, wherein opening of said container by opening said lid requires both removal of said tab and breaking of said first tear off webs, wherein said removable tab is directly connected to said ring and to said lid by a plurality of second tear off and tamper evident webs, wherein the removable tab covers a window with a surface being at least partially provided in the lid and wherein, upon removal of the tab, an outside surface of the container is exposed, and wherein the exposed outside surface is defined by the window.

12. The package of claim 11, wherein said lid is additionally connected to said ring by a hinge.

13. The package of claim 11, wherein said first tear off webs are located at predetermined distances.

14. The package of claim 11, wherein said first tear off webs are located at equidistant points.

15. The package of claim 11, wherein said closure is circular or ellipsoid.

16. The package of claim 11, wherein a hinge is located opposite to said removable tab on said ring of said lid.

17. The package of claim 11, where said closure has a height from about 10 mm to about 40 mm.

18. The package of claim 17, wherein said closure has a diameter from about 10 mm to about 50 mm.

19. The package of claim 18, wherein said removable tab has a width from about 8 mm to about 40 mm.

20. The package of claim 19, wherein said removable tab has a height from about 2 mm to about 20 mm.

* * * * *